US009716327B2

(12) United States Patent
Daly

(10) Patent No.: US 9,716,327 B2
(45) Date of Patent: Jul. 25, 2017

(54) SYSTEM, CIRCUIT MODULE, AND CIRCUIT MODULE CONNECTOR

(71) Applicant: Intel Corporation, Santa Clara, CA (US)

(72) Inventor: Gregory M. Daly, Seattle, WA (US)

(73) Assignee: Intel Corporation, Santa Clara, CA (US)

( * ) Notice: Subject to any disclaimer, the term of this patent is extended or adjusted under 35 U.S.C. 154(b) by 171 days.

(21) Appl. No.: 13/630,732

(22) Filed: Sep. 28, 2012

(65) Prior Publication Data

US 2014/0094063 A1 Apr. 3, 2014

(51) Int. Cl.
*H01R 12/73* (2011.01)
*H01R 12/71* (2011.01)

(52) U.S. Cl.
CPC ..... *H01R 12/732* (2013.01); *H01R 12/716* (2013.01); *H01R 12/73* (2013.01); *H01R 12/737* (2013.01)

(58) Field of Classification Search
CPC ..... H01R 12/732
USPC ..... 439/74, 218, 629, 630, 637
See application file for complete search history.

(56) References Cited

U.S. PATENT DOCUMENTS 3,479,634 A * 11/1969 Pritulsky ..... H01R 12/728 439/560
3,611,275 A * 10/1971 Leddy ..... H01R 12/728 338/332
3,848,952 A * 11/1974 Tighe, Jr. ..... 439/326
4,222,622 A * 9/1980 Griffin ..... H05K 7/1076 439/71
4,603,928 A * 8/1986 Evans ..... 439/61
4,746,299 A * 5/1988 Matsuoka ..... H01R 12/7076 439/525
4,755,146 A * 7/1988 Rishworth ..... H05K 7/1046 361/690
4,938,701 A * 7/1990 Heberling ..... 439/65
4,993,956 A * 2/1991 Pickles et al. ..... 439/76.1
5,112,231 A * 5/1992 Harwath et al. ..... 439/60
5,335,146 A * 8/1994 Stucke ..... 361/785
5,425,651 A * 6/1995 Thrush et al. ..... 439/326
6,097,883 A * 8/2000 Dell et al. ..... 710/301
6,179,627 B1 * 1/2001 Daly et al. ..... 439/76.1
6,347,039 B1 * 2/2002 Lee ..... 361/760
6,388,886 B1 * 5/2002 Tobita ..... 361/760
6,394,817 B1 * 5/2002 Kihira et al. ..... 439/76.1
6,402,556 B1 * 6/2002 Lang et al. ..... 439/632
6,425,766 B1 * 7/2002 Panella ..... 439/59
(Continued)

*Primary Examiner* — James Harvey
(74) *Attorney, Agent, or Firm* — Blakely, Sokoloff, Taylor & Zafman LLP

(57) ABSTRACT

Embodiments of the invention relate to a system, circuit module, and connector. According to one embodiment, a circuit module connector includes first and second sets of opposing contacts on a first section of the connector; the first and second sets of opposing contacts are to contact corresponding first and second sets of contacts on opposite surfaces of a circuit module. The connector also includes a third set of contacts on a second section of the connector; the third set of contacts is to contact a corresponding third set of contacts on one of the surfaces of the circuit module. In one embodiment, the connector connects a memory module to a main board via first and second opposing sets of contacts and a third set of contacts.

18 Claims, 10 Drawing Sheets

(56) References Cited

U.S. PATENT DOCUMENTS

| | | | | |
|---|---|---|---|---|
| 6,438,014 | B2 * | 8/2002 | Funaba et al. | 365/63 |
| 6,585,525 | B2 * | 7/2003 | Jung et al. | 439/55 |
| 6,688,892 | B2 * | 2/2004 | Fukumoto | H01R 13/04 439/65 |
| 6,896,561 | B2 * | 5/2005 | Lai | 439/862 |
| 7,200,023 | B2 * | 4/2007 | Foster, Sr. | 365/63 |
| 7,708,599 | B2 * | 5/2010 | Guan et al. | 439/636 |
| 8,002,583 | B2 * | 8/2011 | van Woensel | 439/607.56 |
| 8,684,768 | B2 * | 4/2014 | Huang et al. | 439/541.5 |
| 2002/0042223 | A1 * | 4/2002 | Belopolsky et al. | 439/541.5 |
| 2002/0115318 | A1 * | 8/2002 | Apicelli | 439/108 |
| 2006/0276075 | A1 * | 12/2006 | Iida et al. | 439/492 |
| 2007/0238323 | A1 * | 10/2007 | Mathews et al. | 439/65 |
| 2008/0038961 | A1 * | 2/2008 | Park et al. | 439/630 |
| 2009/0069081 | A1 * | 3/2009 | Thorner | 463/30 |
| 2009/0227146 | A1 * | 9/2009 | Kimura et al. | 439/637 |
| 2010/0041276 | A1 * | 2/2010 | Tsai et al. | 439/629 |
| 2010/0062624 | A1 * | 3/2010 | Tsai | 439/74 |
| 2010/0173527 | A1 * | 7/2010 | Zhou | 439/630 |
| 2011/0130041 | A1 * | 6/2011 | Chen et al. | 439/630 |
| 2011/0136388 | A1 * | 6/2011 | Fu et al. | 439/637 |
| 2011/0151701 | A1 * | 6/2011 | Ngo | 439/327 |
| 2011/0151716 | A1 * | 6/2011 | Kondo | 439/607.01 |
| 2011/0176864 | A1 * | 7/2011 | Shin et al. | 403/270 |
| 2011/0300759 | A1 * | 12/2011 | Ngo | 439/630 |
| 2012/0003849 | A1 * | 1/2012 | Luo | 439/74 |
| 2012/0302074 | A1 * | 11/2012 | Hartenstein | H01R 12/737 439/78 |
| 2014/0094063 | A1 * | 4/2014 | Daly | 439/629 |
| 2014/0227911 | A1 * | 8/2014 | Lim et al. | 439/660 |

* cited by examiner

SYSTEM, CIRCUIT MODULE, AND CIRCUIT MODULE CONNECTOR

BACKGROUND

Computing devices are getting smaller, thinner, and lighter. Many circuit module designers are creating circuit modules for such computing devices with improvements in features (e.g., improved power management), but without modifications to or improvements in the physical size, shape, or configuration. For example, memory technologies continue to improve, but system designers for laptops, ultrabooks, netbooks, tablets, smart phones, and other compact and/or handheld computing devices are limited to small outline dual in-line memory modules (SODIMM) or some form of memory down.

Systems with "memory down" include memory chips that are mounted directly onto a circuit board (via, for example, soldering). Memory down systems lack platform flexibility and serviceability. An end-user cannot upgrade the amount of memory contained within a system using memory down. Furthermore, manufacturers producing memory down systems cannot swap out bad memory chips, resulting in decreased product yield.

SODIMMs are memory modules with smaller dimensions than standard DIMMs. The modularity of SODIMMs offers flexibility: manufacturers can offer systems with different configurations, and users can often upgrade systems with SODIMMs. However, the relatively large size of SODIMMs limits how compact computing devices can be made.

BRIEF DESCRIPTION OF THE DRAWINGS

The following description includes discussion of figures having illustrations given by way of example of implementations of embodiments of the invention. The drawings should be understood by way of example, and not by way of limitation. As used herein, references to one or more "embodiments" are to be understood as describing a particular feature, structure, or characteristic included in at least one implementation of the invention. Thus, phrases such as "in one embodiment" or "in an alternate embodiment" appearing herein describe various embodiments and implementations of the invention, and do not necessarily all refer to the same embodiment. However, they are also not necessarily mutually exclusive. In the following description and claims, the term "coupled" and its derivatives may be used. The term "coupled" herein may refer to two or more elements which are in direct contact (physically, electrically, magnetically, optically, etc.), or to two or more elements that are not in direct contact with each other, but which still interact with each other.

DETAILED DESCRIPTION

Embodiments of the invention relate to a system, circuit module, and circuit module connector with a third set of contacts. Connectors connect circuit modules to other circuit modules or boards (e.g., main boards, or other modules, cards, or boards). In particular, embodiments relate to card-edge connectors, which connect a circuit card to other circuit modules or boards via an edge of the circuit card. In one example, a memory connector connects a memory module to a main board (i.e., motherboard) via two sets of opposing contacts on one section of the connector, and a third set of contacts on another section of the connector.

According to one embodiment, the connector includes one or more rigid supports to connect the two sections of the connector, and/or to aid with strength and alignment of contacts. The connector can also include one or more retention mechanisms to secure the circuit module to the connector.

In one embodiment, the circuit module connector and corresponding circuit modules enable flexibility and scalability, while enabling compact form factors and increased contact space.

In the following description, numerous details are discussed to provide a more thorough explanation of embodiments of the present invention. It will be apparent, however, to one skilled in the art, that embodiments of the present invention may be practiced without these specific details. In other instances, well-known structures and devices are shown in block diagram form, rather than in detail, in order to avoid obscuring embodiments.

Note that in the corresponding drawings of the embodiments, signals are represented with lines. Some lines may be thicker, to indicate more constituent signal paths, and/or have arrows at one or more ends, to indicate primary information flow direction. Such indications are not intended to be limiting. Rather, the lines are used in connection with one or more exemplary embodiments to facilitate easier understanding of a circuit or a logical unit. Any represented signal, as dictated by design needs or preferences, may actually comprise one or more signals that may travel in either direction and may be implemented with any suitable type of signal scheme.

Figure 1A:
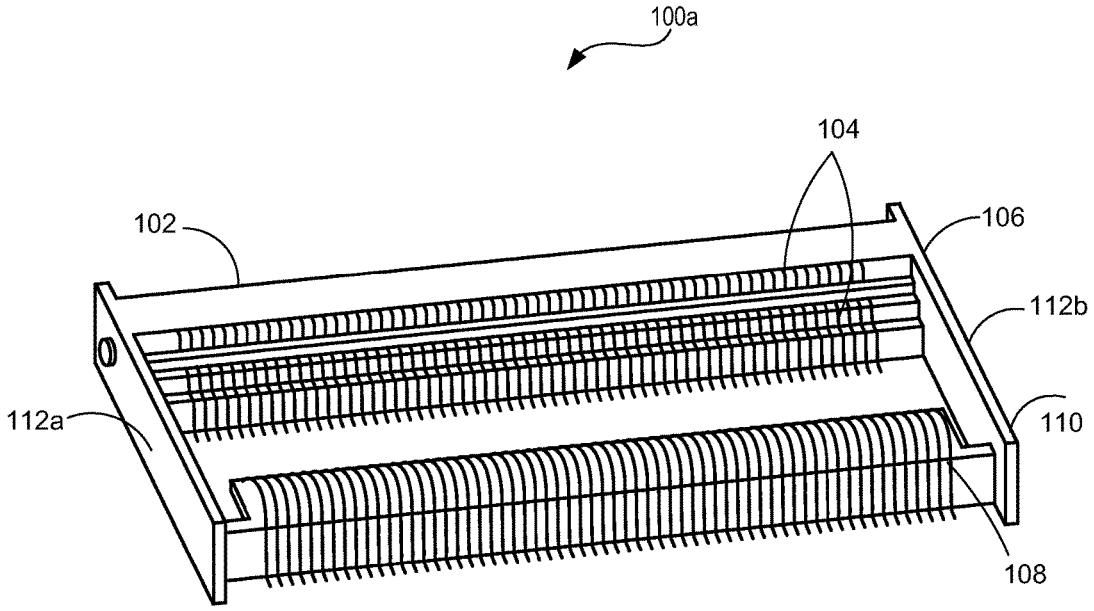
FIGS. 1A, 1B, 1C and 1D illustrate isometric views of circuit module connectors with first and second sets of opposing contacts, and third sets of contacts, according to embodiments of the invention.
Figure 1B:
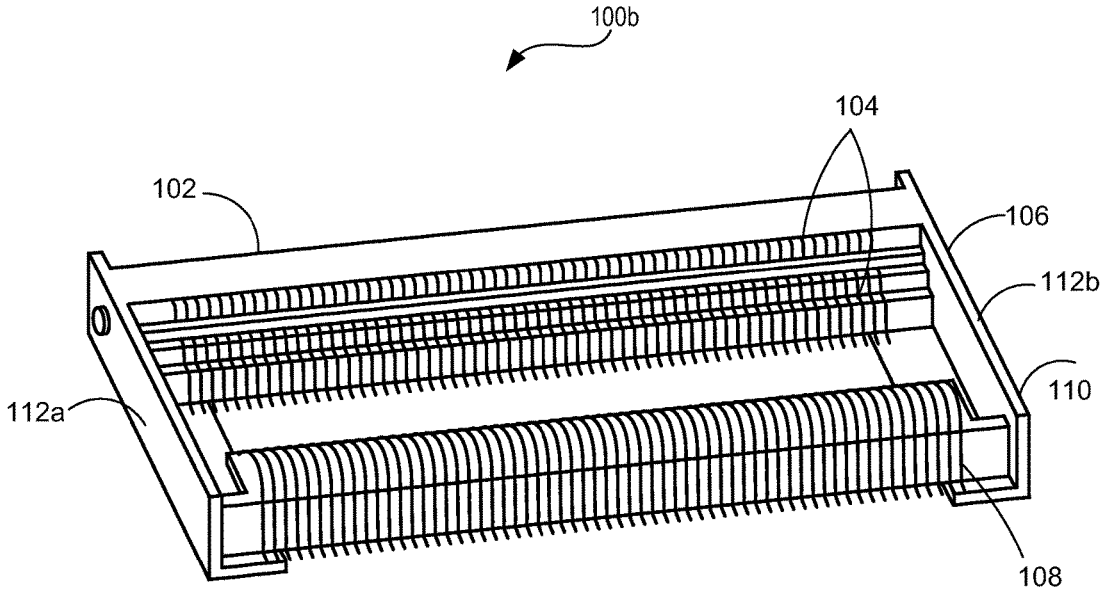
Figure 1C:
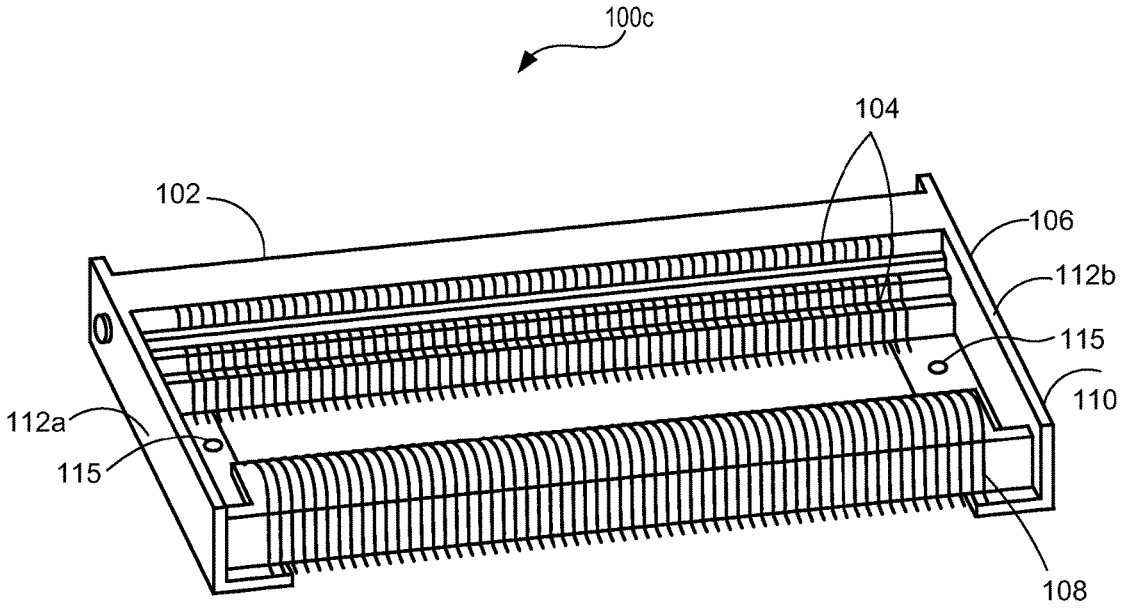
Figure 1D:
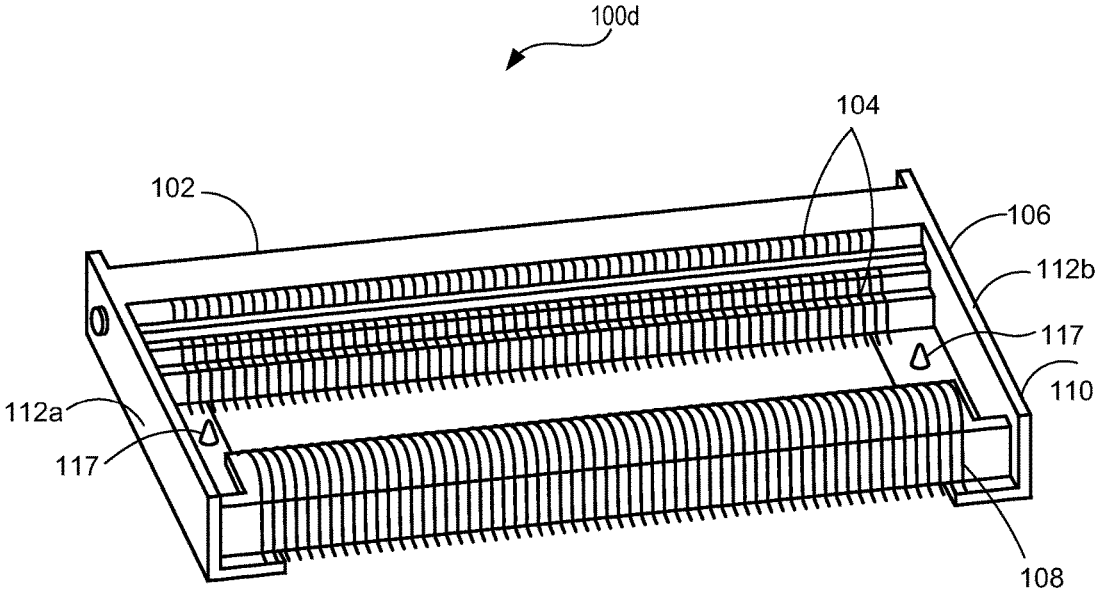

FIGS. 1A and 1B illustrate isometric views of circuit module connectors with first and second sets of opposing contacts, and third sets of contacts, according to embodiments of the invention.

Embodiments of the invention include first and second sets of opposing contacts on a first section of the connector. Contacts are areas providing an electrical connection between two circuits or circuit components (e.g., between a circuit module and a circuit board). Contacts can include pins (e.g., pins which are arched to enable compression and to generate tension when in contact with corresponding contacts, straight pins, or any other type and/or shape of pins), or any other conductive contacts providing an electrical connection. The first and second sets of opposing contacts are to contact corresponding first and second sets of contacts on opposite surfaces of a circuit module. For example, connectors 100*a* and 100*b* include two sets of opposing contacts 104 on a first section 106 of the connector to contact corresponding sets of contacts on a circuit module (e.g., circuit module 200*a* of FIG. 2A).

The connector includes a third set of contacts on a second section of the connector; the third set of contacts is to contact a corresponding third set of contacts on one of the surfaces of the circuit module. For example, connectors 100*a* and 100*b* include a third set of contacts 108 on a second section 110 of the connectors 100*a* and 100*b*. In one embodiment, a slot on the first section 106 is to accept a first edge of a circuit module, and the second section 110 is to contact a second edge of the circuit module opposite to the first edge. According to one embodiment, the third set of contacts 108 includes arched pins. Arched pins can enable improved contact with the corresponding contacts on the circuit module.

In one embodiment, the third set of contacts 108 is unopposed (e.g., the third set of contacts 108 does not have a set of contacts opposite to the set). According to one embodiment, a connector with a third set of contacts increases available pin counts, enabling more compact form factors.

In another embodiment, the connector includes a fourth set of contacts (not shown) opposing the third set of contacts 108. For example, a third section of the connector that clamps down over a circuit module over the second section 110 of the connector can include a fourth set of contacts; the fourth set of contacts is to contact a corresponding fourth set of contacts on a surface of the circuit module. In one such example, the third section of the connector extends the length of the connector to provide the fourth set of contacts with a similar or equal number of contacts as the third set of contacts. In another example, the third and fourth sets of contacts are located on a removable section into which a circuit module is first inserted (e.g., resembling the arrangement of contacts on the first section 106 as illustrated in FIGS. 1A and 1B); the circuit module and attached removable section are then inserted into the slot of the first section 106, and secured onto the circuit board onto which the connector is disposed.

The first and second sets of opposing contacts 104 and the third set of contacts 108 are illustrated as continuous rows of contacts; however, each set of contacts can be non-continuous (e.g., include gaps), or be arranged in different configurations. Additionally, although the first and second sections are illustrated as two opposing sides, connectors can include other shapes and/or configurations. For example, the connector could include a third set of contacts on an adjacent side (e.g., where the rigid supports 112*a* and/or 112*b* are illustrated). In another example, the connector includes the first and second sets of opposing contacts along two sides of a triangular configuration, and the third set of contacts is on the third side of the triangular configuration.

Connectors 100*a* and 100*b* include connector housing 102. The connector housing 102 can be made from any suitable housing material, such as plastic, a resin, a polymer, or any other any material providing sufficient electrical insulation. The connector housing 102 can be formed from a single piece (e.g., via injection molding, three dimensional (3D) printing, or any other method of forming a single piece), or formed from two or more pieces. When formed from two or more pieces, the pieces can be assembled in any way known in the art. For example, the pieces can be assembled via fastening (e.g., with screws or other fasteners), adhesives, welding of the pieces, or by any other method of assembling the pieces.

As illustrated, connector housing 102 includes two rigid supports 112*a* and 112*b* connecting the first section 106 of the connector with the second section 110 of the connector. In other embodiments, zero, one, or more rigid supports can connect the sections of the connector. For example, in one embodiment, a rigid frame around the first and second sections provides support. In another example, the connector includes a rigid support connecting inner portions of the first section 106 and the second section 110. Rigid supports can provide strength and stability (e.g., during manufacture, test, shipping, installation, or any other circumstances in which the connector may be handled or moved). The embodiment illustrated in FIG. 1B includes rigid supports 112*a* and 112*b* which are L-shaped. In one embodiment, the connector includes a T-shaped rigid support. L-shaped and T-shaped rigid supports can provide additional area for retention mechanisms (e.g., key/protrusion and hole mechanisms, holes for fasteners, clips, or other retention mechanisms), increase strength, and/or improve alignment. For example, L-shaped and T-shaped supports can minimize warping during manufacture and during other times in which the connector is handled.

Figure 2A:
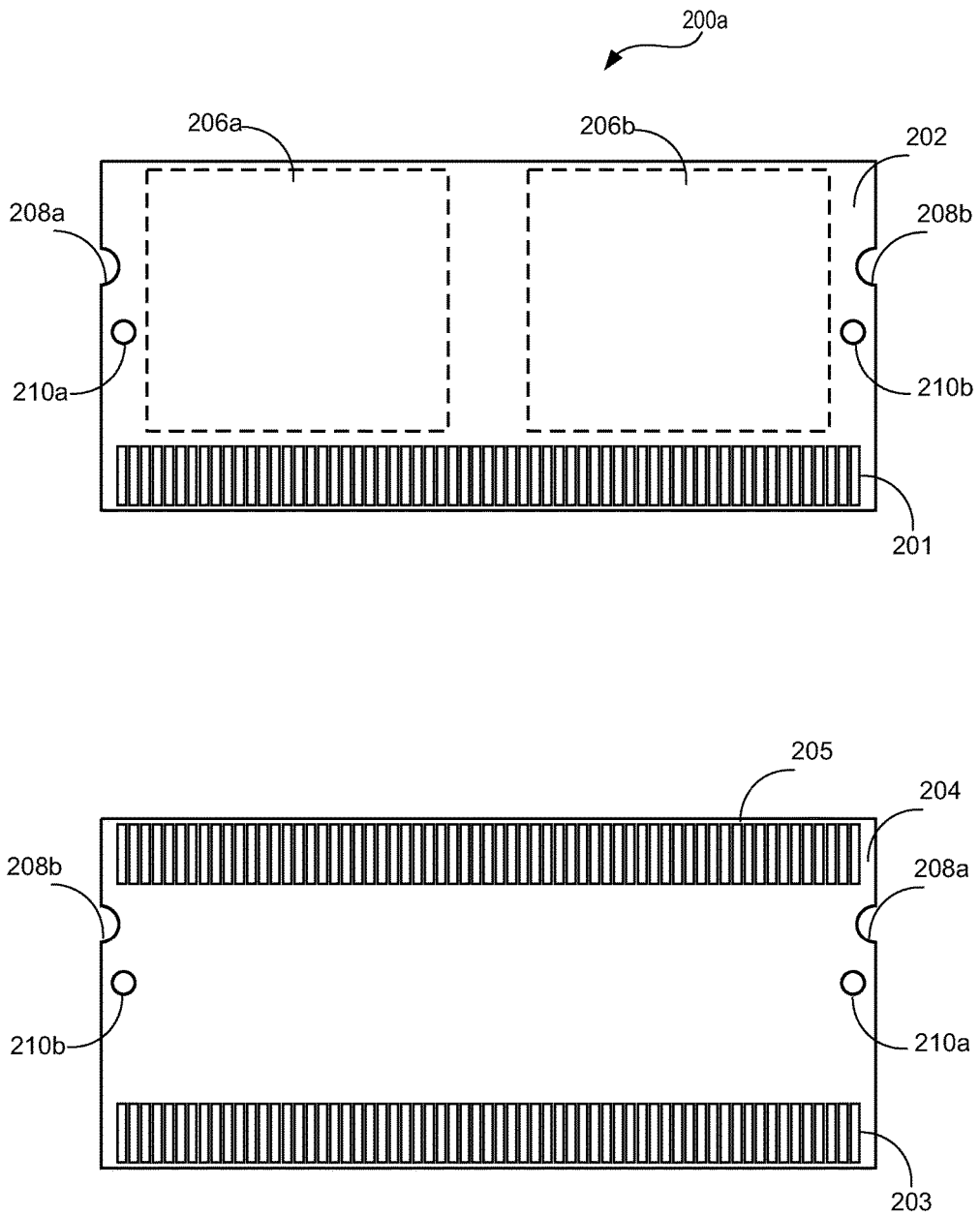
FIGS. 2A-2C illustrate plan views of top and bottom surfaces of circuit modules with first and second sets of contacts on opposite surfaces of the circuit module and third sets of contacts on the bottom surfaces of the circuit module, according to embodiments of the invention.
Figure 2B:
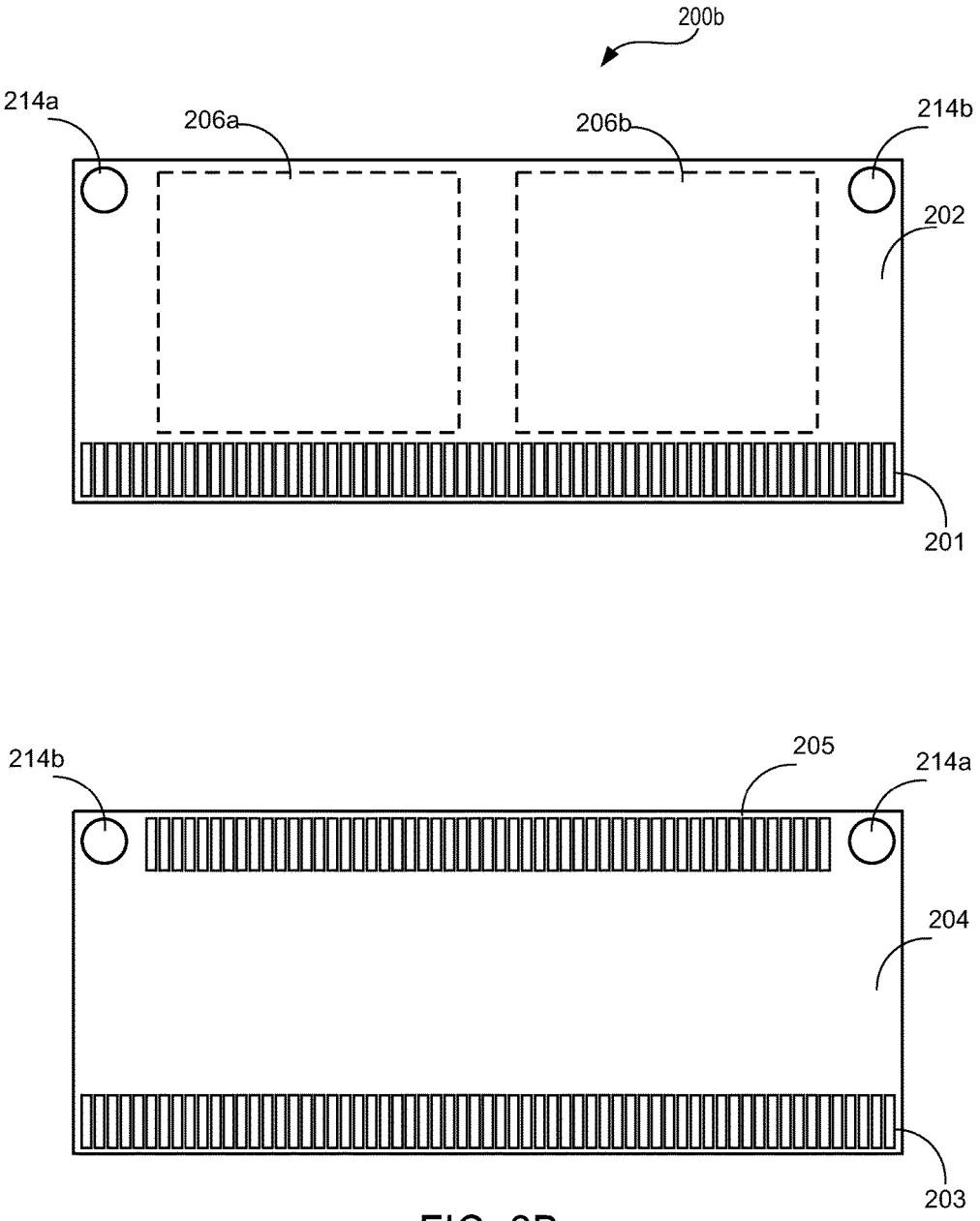
Figure 2C:
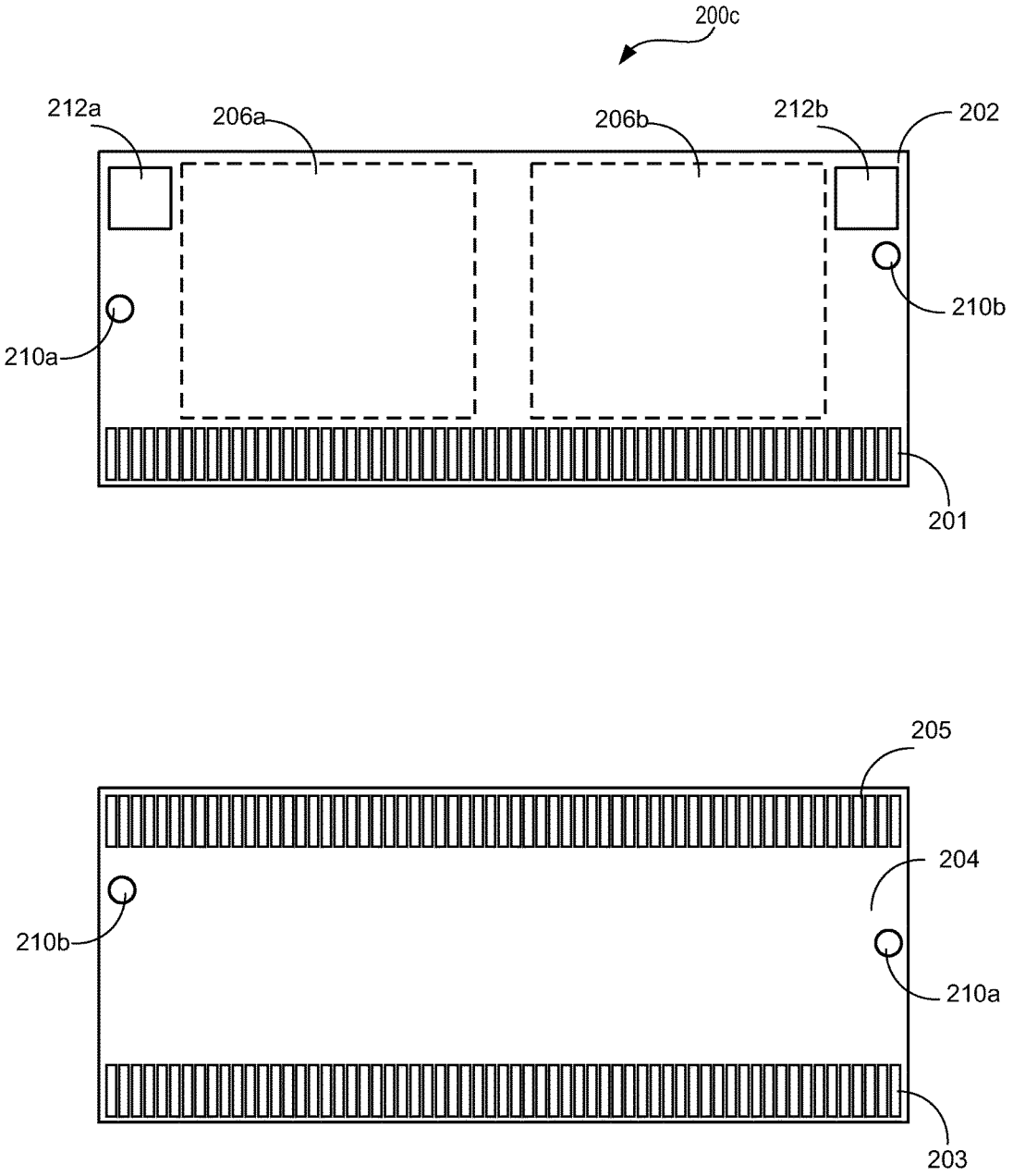

FIGS. 2A-2C illustrate plan views of top and bottom surfaces of circuit modules with first and second sets of contacts on opposite surfaces of the circuit module and third sets of contacts on the bottom surfaces of the circuit modules, according to embodiments of the invention.

According to embodiments of the invention, a circuit module includes first and second sets of contacts on opposite surfaces of the circuit module to contact corresponding first and second sets of opposing contacts on a first section of a connector. For example, circuit modules 200*a*-200*c* each include a first set of contacts 201 on a top surface 202, and a second set of contacts 203 on a bottom surface 204 of the circuit module.

The circuit modules 200*a*-200*c* also each include a third set of contacts on the bottom surface of the circuit module to contact a corresponding third set of contacts on a connector. For example, circuit modules 200*a*-200*c* each include a third set of contacts 205 on surface 204. The circuit modules 200*a*-200*c* are to be connected to circuit boards via connectors (e.g., connector 100*a* of FIG. 1A), with the sets of contacts on the circuit module aligning with the corresponding sets of contacts on the connector. The sets of contacts on the circuit modules can have the same or a different pitch. The pitch is the distance between the center of one contact to the center of a neighboring contact. The mechanical stability and reliability of alignment between contacts on the circuit module with contacts on the connector influence the possible pitch sizes. For example, a circuit module and connector with accurate alignment mechanisms can have a small pitch, enabling more contacts in the given space. Examples of alignment mechanisms are described below in greater detail. In one embodiment, the pitch of the sets of contacts 201 and 203 along the edge of the circuit module to contact the first and second opposing contacts of the connector have a smaller pitch than the third set of contacts 205. In another embodiment, the sets of contacts 201 and 203 have the same pitch as the third set of contacts 205.

Any number of contacts can be included on circuit modules 200*a*-200*c*; the number of possible contacts is determined based on circuit module dimensions (e.g., height and width), contact pitch, and/or available edge space. In one embodiment, the circuit module is approximately 31 mm wide and has a height of approximately 15 mm. In one such embodiment, pins having a pitch of 0.45 mm can result in a configuration with 189 pins. In another embodiment, the circuit module is approximately 34 mm wide and has a height of 15 mm. In one such embodiment, pins having a pitch of 0.5 mm can result in a configuration with 179 pins.

The circuit module can be any type of circuit module using a connector, for example, a memory module, a graphics card, a processor, or any other circuit module and/or card. A memory module can include, for example, a dual inline memory module (DIMM) comprising a third set of contacts (e.g., the third set of contacts 205).

As illustrated, circuit modules 200*a*-200*c* include areas 206*a* and 206*b*, which can include printed circuitry, mounted circuit chips, and/or other components. For example, areas 206*a* and 206*b* can include DRAMs, processing units, graphics processors, caches, termination resistors, buses, and/or any other circuit chip or component. In one example, areas 206*a* and 206*b* each include a DRAM chip (e.g., a 32*b* DRAM chip). Although two areas are illustrated, any number of chips or components can be included in any configuration on the surfaces of circuit modules 200*a*-200*c*. For example, although the bottom surface 204 is illustrated as including no areas for chips or other circuitry, either of the surfaces 202 and 204, or both of the surfaces 202 and 204 can include circuitry and/or components.

Circuit modules and connectors also include retention and/or alignment mechanisms. In one embodiment, a circuit module includes one or more holes, to accept one or more protrusions 117 on a connector. For example, circuit modules 200*a* and 200*c* includes holes 210*a* and 210*b*. The holes 210*a* and 210*b* are to, for example, align the sets of contacts on the circuit module to the corresponding sets of contacts on the connector. The holes 210*a* and 210*b* and corresponding protrusions 117 on connectors can also aid in retaining the circuit modules 200*a* and 200*c* on a connector. The one or more protrusions 117 on the connector can include various shapes to improve guidance and/or secure the circuit module to the connector. For example, a protrusion can include a tapered shape (e.g., a cone shape), which enables easy initial insertion due to a narrow upper portion, and then allows the circuit module to align with the connector as the circuit module slides down the tapered protrusion onto a wider base of the protrusion.

The one or more protrusions can be disposed on rigid supports of the connector (e.g., rigid supports 112*a* and 112*b* of FIGS. 1A and 1B). Holes located on the sides of the circuit module without contacts (which, for example, correspond to protrusions on the rigid supports 112*a* and 112*b* of FIGS. 1A and 1B) can free up space for additional contacts. One or more protrusions can also (or alternatively) be disposed on one or both sections of the connector with contacts (e.g., on the first section 106 and/or on the second section 110 of connectors 100*a* and 100*b* of FIG. 1).

Although two holes are illustrated, circuit modules can include any number of holes (e.g., zero, one, or more holes), in any configuration. Furthermore, although holes are illustrated in FIG. 2A as being at equal distances from the edges of the circuit module 200*a*, holes can be at different distances. For example, the holes 210*a* and 210*b* of circuit module 200*c* of FIG. 2C are located at different distances from the edges of the circuit module.

In one embodiment, a circuit module includes one or more notches to aid in aligning the contacts of the circuit module with the contacts of the connector. For example, circuit module 200*a* includes notches 208*a* and 208*b*, which align with corresponding keys on a connector.

According to one embodiment, a circuit module includes a hole to align with a second hole 115 on a connector; the hole and the second hole 115 are to accept a screw to aid in retaining the circuit module on the connector. For example, circuit module 200*b* of FIG. 2B includes holes 214*a* and 214*b* for retention of the module. The holes 214*a* and 214*b* are illustrated as being located on one of the edges of the module including contacts, which can reduce the number of contacts that can fit on that edge. Holes for accepting fasteners can be disposed at other areas of the circuit module (e.g., one or both sides of the module without contacts, and/or the central area of the circuit module. In one embodiment, the screws or other conductive fasteners to be accepted by the holes 214*a* and 214*b* also function to deliver power and/or provide ground contacts.

In one embodiment, a circuit module includes areas onto which a section of a connector applies force. For example, circuit modules 200*c* of FIG. 2C includes areas 212*a* and 212*b* onto which a third section of a connector applies force to maintain contact between the third set of contacts 205 and a corresponding third set of contacts on the connector. In one such example, the third section of the connector to apply force includes a spring (e.g., one or more spring clips). In one such embodiment, the areas 212*a* and/or 212*b* includes contacts to deliver power to the circuit module and/or ground contacts.

Figure 3:
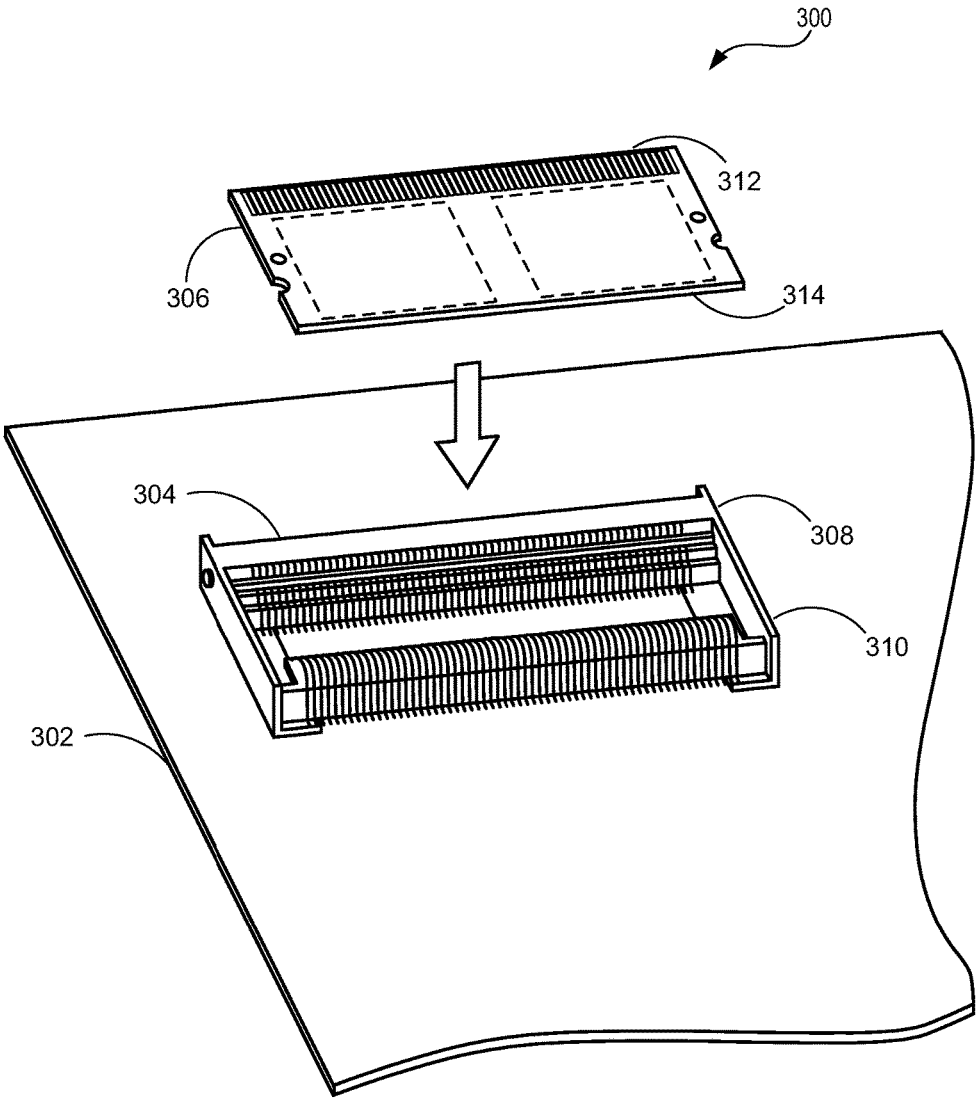
FIG. 3 illustrates an exploded isometric view of a system including a circuit board, a circuit module connector, and a circuit module, according to one embodiment of the invention.

FIG. 3 illustrates an exploded isometric view of a system, including a circuit board, a connector, and a circuit module, according to one embodiment of the invention.

In one embodiment, a circuit board (e.g., a main board of a computing device), includes a connector, which is to accept a circuit module. For example, the system 300 includes a circuit board 302, a connector 304, and a circuit module 306. The connector 304 is to connect the circuit module 306 to the circuit board 302. The circuit module 306 and connector 304 can include any of the embodiments described herein. The connector includes first and second sets of opposing contacts on a first section 308 of the connector; the first and second sets of opposing contacts are to contact corresponding first and second sets of contacts on opposite surfaces of the circuit module 306 (e.g., the contacts on the first section 308 of the connector 304 are to contact contacts on the top and bottom surfaces along the edge 312 of the circuit module 306).

The connector also includes a third set of contacts on a second section 310 of the connector 304; the third set of contacts is to contact a corresponding third set of contacts on one of the surfaces of the circuit module (e.g., the contacts on the second section 310 of the connector 304 are to contact contacts on the bottom surface along the edge 314 of the circuit module 306.).

In one embodiment, the circuit module 306 is to be inserted at an angle into the connector 304 on the circuit board 302. One such embodiment includes a "right-angle" connector. For example, a first edge 312 of the circuit module 306 is to be inserted at an angle into a slot on the first section 308 of the connector. The second edge 314 of the circuit module is then to be lowered onto the third set of pins on the second section 310 of the connector 304. In one such embodiment, the circuit module 306 snaps into place onto the connector 304. The third set of contacts on the bottom surface of circuit module 306 is to contact the third set of contacts on the connector 304. In one such embodiment, the inserted circuit module and the connector are to be disposed substantially coplanar (e.g., substantially parallel) with the circuit board 302. The coplanar arrangement of the system 300 enables a low profile suitable for compact computing devices. For example, an implementation where the circuit module 306 has circuit components on a single surface (e.g., the top surface of the circuit module 306 which is visible in system diagram 300), the coplanar arrangement enables the system to achieve a Z-height of 3-3.5 mm.

Figure 4:
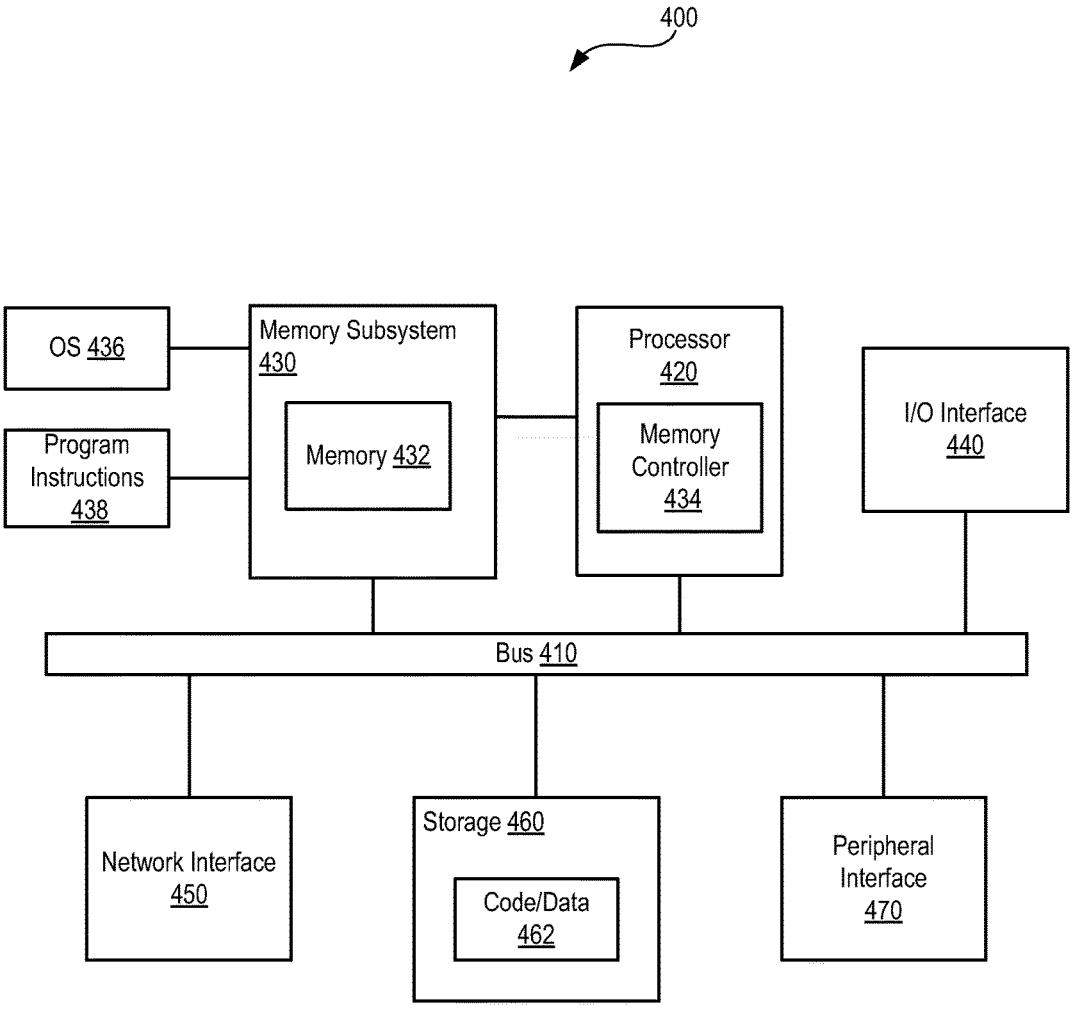
FIG. 4 is a block diagram of a computing system in which embodiments of the invention may be implemented.

FIG. 4 is a block diagram of a computing system in which embodiments of the invention may be implemented.

System 400 represents a computing device in accordance with any embodiment described herein, and can be a laptop computer, a desktop computer, a server, a gaming or entertainment control system, a scanner, copier, printer, or other electronic device. One or more components of system 400 can include connectors and/or circuit modules in accordance with embodiments described herein. It will be understood that certain of the components are shown generally, and not all components of a computing system are shown in system 400. System 400 includes processor 420, which provides processing, operation management, and execution of instructions for system 400. Processor 420 can include any type of microprocessor, central processing unit (CPU), processing core, or other processing hardware to provide processing for system 400. Processor 420 controls the overall operation of system 400, and can include one or more programmable general-purpose or special-purpose microprocessors, digital signal processors (DSPs), programmable controllers, application specific integrated circuits (ASICs), programmable logic devices (PLDs), or the like, or a combination of such devices.

Memory subsystem 430 can represent main memory, cache, or any other memory (e.g., any device providing storage for code to be executed by processor 420 or data values) for system 400. Memory subsystem 430 includes memory 432, which represents one or more memory devices that can include read-only memory (ROM), flash memory, one or more varieties of random access memory (RAM), or other memory devices, or a combination of such devices. Processor 420 includes a memory controller 434, which can control read and write operations to and from memory 432. In one embodiment, memory subsystem 430 includes memory controller 434. In one embodiment, memory subsystem 430 is located on processor 420. In another embodiment, memory subsystem 430 is located on a separate device. In yet another embodiment, one or more parts of memory subsystem 430 are located on processor 420 and other parts of memory subsystem 430 are located on a separate device. In one embodiment, memory 432 could be designed as a cache and included as part of processor 420.

Memory subsystem 430 can store and host, among other things, operating system (OS) 436 to provide a software platform for execution of instructions in system 400. Additionally, other program instructions 438 are stored and executed from memory subsystem 430 to provide the logic and the processing of system 400. OS 436 and program instructions 438 are executed by processor 420.

Processor 420 and memory subsystem 430 are coupled to bus/bus system 410. Bus 410 is an abstraction that represents any one or more separate physical buses, communication lines/interfaces, and/or point-to-point connections, connected by appropriate bridges, adapters, and/or controllers. Therefore, bus 410 can include, for example, one or more of a system bus, a Peripheral Component Interconnect (PCI) bus, a HyperTransport or industry standard architecture (ISA) bus, a small computer system interface (SCSI) bus, a universal serial bus (USB), or an Institute of Electrical and Electronics Engineers (IEEE) standard 1394 bus (commonly referred to as "Firewire"). The buses of bus 410 can also correspond to interfaces in network interface 450.

In one embodiment, bus 410 includes a data bus that is a data bus included in memory subsystem 430 over which processor 420 can read values from memory 432. The additional line shown linking processor 420 to memory subsystem 430 represents a command bus over which processor 420 provides commands and addresses to access memory 432.

System 400 also includes one or more input/output (I/O) interface(s) 440, network interface 450, one or more internal mass storage device(s) 460, and peripheral interface 470 coupled to bus 410. I/O interface 440 can include one or more interface components through which a user interacts with system 400 (e.g., video, audio, and/or alphanumeric interfacing). Network interface 450 provides system 400 the ability to communicate with remote devices (e.g., servers, other computing devices) over one or more networks. Network interface 450 can include an Ethernet adapter, wireless interconnection components, USB (universal serial bus), one or more antennae, or other wired or wireless standards-based or proprietary interfaces.

Storage 460 can be or include any conventional medium for storing large amounts of data in a nonvolatile manner, such as one or more magnetic, solid state, or optical based disks, or a combination. Storage 460 holds code or instructions and data 462 in a persistent state (i.e., the value is retained despite interruption of power to system 400). Storage 460 can also be generically considered to be a "memory." Whereas storage 460 is nonvolatile, memory 432 can include volatile (i.e., the value or state of the data is indeterminate if power is interrupted to system 400) and/or non-volatile memory.

Peripheral interface 470 can include any hardware interface not specifically mentioned above. Peripherals refer generally to devices that connect dependently to system 400. A dependent connection is one where system 400 provides the software and/or hardware platform on which operation executes, and with which a user interacts.

Various components described herein can be a means for performing the operations or functions described. Each component described herein includes software, hardware, or a combination of these. The components can be implemented as software modules, firmware modules, hardware modules, special-purpose hardware (e.g., application specific hardware, application specific integrated circuits (ASICs), digital signal processors (DSPs), or other special-purpose hardware), embedded controllers, hardwired circuitry, or as any combination of software, firmware, and/or hardware.

Figure 5:
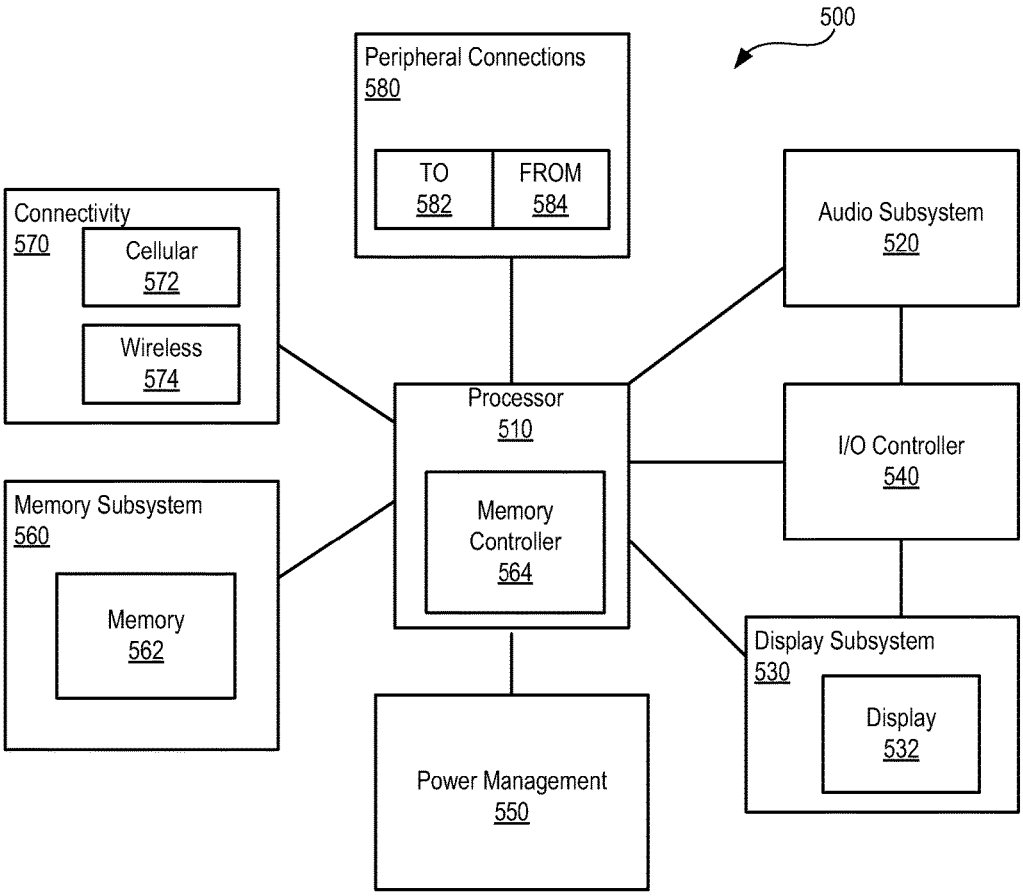
FIG. 5 is a block diagram of an embodiment of a mobile device in which embodiments of the invention may be implemented.

FIG. 5 is a block diagram of an embodiment of a mobile device in which embodiments of the invention may be implemented.

Device 500 represents a mobile computing device, such as a computing tablet, a mobile phone or smartphone, a wireless-enabled e-reader, or other mobile device. One or more components of system 400 can include connectors and/or circuit modules in accordance with embodiments described herein. It will be understood that certain of the components are shown generally, and not all components of such a device are shown in device 500.

Device 500 includes processor 510, which performs the primary processing operations of device 500. Processor 510 can include one or more physical devices, such as microprocessors, application processors, microcontrollers, programmable logic devices, or other processing means. In one embodiment, processor 510 includes optical interface components in addition to a processor die. Thus, the processor die and photonic components are in the same package. Such a processor package can interface optically with an optical connector in accordance with any embodiment described herein.

The processing operations performed by processor 510 include the execution of an operating platform or operating system on which applications and/or device functions are executed. The processing operations include operations related to I/O (input/output) with a human user or with other devices, operations related to power management, and/or operations related to connecting device 500 to another device. The processing operations can also include operations related to audio I/O and/or display I/O.

In one embodiment, device 500 includes audio subsystem 520, which represents hardware (e.g., audio hardware and audio circuits) and software (e.g., drivers, codecs) components associated with providing audio functions to the computing device. Audio functions can include speaker and/or headphone output, as well as microphone input. Devices for such functions can be integrated into device 500, or connected to device 500. In one embodiment, a user interacts with device 500 by providing audio commands that are received and processed by processor 510.

Display subsystem 530 represents hardware (e.g., display devices) and software (e.g., drivers) components that provide a visual and/or tactile display for a user to interact with the computing device. Display subsystem 530 includes display 532, which includes the particular screen or hardware device used to provide a display to a user. In one embodiment, display 532 includes logic separate from processor 510 to perform at least some processing related to the display. In one embodiment, display subsystem 530 includes a touchscreen device that provides both output to and input from a user.

I/O controller 540 represents hardware devices and software components related to interaction with a user. I/O controller 540 can operate to manage hardware that is part of audio subsystem 520 and/or display subsystem 530. Additionally, I/O controller 540 illustrates a connection point for additional devices that connect to device 500 through which a user might interact with the system. For example, devices that can be attached to device 500 might include microphone devices, speaker or stereo systems, video systems or other display device, keyboard or keypad devices, or other I/O devices for use with specific applications such as card readers or other devices.

As mentioned above, I/O controller 540 can interact with audio subsystem 520 and/or display subsystem 530. For example, input through a microphone or other audio device can provide input or commands for one or more applications or functions of device 500. Additionally, audio output can be provided instead of or in addition to display output. In another example, if display subsystem 532 includes a touchscreen, the display device also acts as an input device, which can be at least partially managed by I/O controller 540. There can also be additional buttons or switches on device 500 to provide I/O functions managed by I/O controller 540.

In one embodiment, I/O controller 540 manages devices such as accelerometers, cameras, light sensors or other environmental sensors, gyroscopes, global positioning system (GPS), or other hardware that can be included in device 500. The input can be part of direct user interaction, as well as providing environmental input to the system to influence its operations (such as filtering for noise, adjusting displays for brightness detection, applying a flash for a camera, or other features).

Memory subsystem 560 includes memory 562 for storing information in device 500. Memory 562 can include non-volatile (state does not change if power to the memory device is interrupted) and/or volatile (state is indeterminate if power to the memory device is interrupted) memory devices. Memory 562 can store application data, user data, music, photos, documents, or other data, as well as system data (whether long-term or temporary) related to the execution of the applications and functions of system 500. Processor 510 includes a memory controller 564, which can control read and write operations to and from memory 562. In one embodiment, memory subsystem 560 includes the memory controller 564. In one embodiment, memory subsystem 560 is located on processor 510. In another embodiment, memory subsystem 560 is located on a separate device. In yet another embodiment, one or more parts of memory subsystem 560 are located on processor 510 and other parts of memory subsystem 560 are located on a separate device. In one embodiment, memory 562 is designed as caches and included as part of processor 510.

In one embodiment, device 500 includes power management 550 that manages battery power usage, charging of the battery, and features related to power saving operation. Power management 550 can initiate a transition between two or more power states for system 500, or for select sub-parts of system 500.

Connectivity 570 includes hardware devices (e.g., wireless and/or wired connectors, one or more antennae, and/or communication hardware) and software components (e.g., drivers, protocol stacks) to enable device 500 to communicate with external devices. The device could be separate devices, such as other computing devices, wireless access points or base stations, as well as peripherals such as headsets, printers, or other devices.

Connectivity 570 can include multiple different types of connectivity. To generalize, device 500 is illustrated with cellular connectivity 572 and wireless connectivity 574. Cellular connectivity 572 refers generally to cellular network connectivity provided by wireless carriers, such as provided via GSM (global system for mobile communications) or variations or derivatives, CDMA (code division multiple access) or variations or derivatives, TDM (time division multiplexing) or variations or derivatives, LTE (long term evolution—also referred to as "4G"), or other cellular service standards. Wireless connectivity 574 refers to wireless connectivity that is not cellular, and can include personal area networks (such as Bluetooth), local area networks (such as WiFi), and/or wide area networks (such as WiMax), or other wireless communication. Wireless communication refers to transfer of data through the use of modulated electromagnetic radiation through a non-solid medium. Wired communication occurs through a solid communication medium.

Peripheral connections 580 include hardware interfaces and connectors, as well as software components (e.g., drivers, protocol stacks) to make peripheral connections. It will be understood that device 500 could both be a peripheral device ("to" 582) to other computing devices, as well as have peripheral devices ("from" 584) connected to it. Device 500 commonly has a "docking" connector to connect to other computing devices for purposes such as managing (e.g., downloading and/or uploading, changing, synchronizing) content on device 500. Additionally, a docking connector can allow device 500 to connect to certain peripherals that allow device 500 to control content output, for example, to audiovisual or other systems.

In addition to a proprietary docking connector or other proprietary connection hardware, device 500 can make peripheral connections 580 via common or standards-based connectors. Common types can include a Universal Serial Bus (USB) connector (which can include any of a number of different hardware interfaces), DisplayPort including MiniDisplayPort (MDP), High Definition Multimedia Interface (HDMI), Firewire, or other type.

Besides what is described herein, various modifications can be made to the disclosed embodiments and implementations of the invention without departing from their scope. Therefore, the illustrations and examples herein should be construed in an illustrative, and not a restrictive sense. The scope of the invention should be measured solely by reference to the claims that follow.

I claim:

1. A connector comprising:

first and second sets of opposing signal contacts positioned on different levels of a first stepped section of the connector, the first and second sets of opposing signal contacts to contact corresponding first and second sets of contacts on respective opposite surfaces of a circuit card along a first edge of the circuit card, a slot between the first and second sets of opposing signal contacts, the first edge of the circuit card to be inserted into the slot; and a third set of signal contacts on a second section of the connector, the third set of signal contacts to contact a corresponding third set of contacts on a bottom surface of the circuit card that substantially span across a width of the circuit card, after the first edge of the circuit card has been inserted into the slot, along a second edge of the circuit card that is opposite to the first edge, wherein the third set of signal contacts comprises a third set of unopposed signal contacts on the second section of the connector;

such that when said circuit card is inserted into said connecter there exists first and second planes of connections on opposite sides of the first edge of the circuit card and a third plane of connections on the bottom surface of the circuit card along the second edge of the circuit card.

2. A system comprising:

a circuit board;

a circuit card; and a connector electrically connecting the circuit card to the circuit board, the connector comprising:

first and second sets of opposing signal contacts on different levels of a first stepped section of the connector, the first and second sets of opposing signal contacts to contact corresponding first and second sets of contacts on respective opposite surfaces of the circuit card along a first edge of the circuit card, a slot between the first and second sets of opposing signal contacts, the first edge of the circuit card inserted into the slot; and a third set of unopposed signal contacts on a second section of the connector, the third set of signal contacts having made contact with a corresponding third set of contacts on a bottom surface of the circuit card that substantially span across a width of the circuit card, after the first edge of the circuit card was inserted into the slot, along a second edge of the circuit card that is opposite to the first edge;

such that when the circuit card was inserted into the connecter there existed first and second planes of connections on opposite sides of the first edge of the circuit card and a third plane of connections on the bottom surface of the circuit card along the second edge of the circuit card.

3. The connector of claim 2 further comprising a rigid support that comprises two rigid portions at a perpendicular angle relative to each other, wherein each of the two rigid portions are coupled with the first stepped section of the connector at one end, and the second section of the connector at an opposite end.

4. The connector of claim 1, wherein the circuit card is a dual inline memory module (DIMM) comprising the corresponding third set of signal contacts.

5. The connector of claim 2, wherein each of the first, second, and third sets of signal contacts has the same pitch in a range of 0.45 to 0.5 mm.

6. The connector of claim 1, further comprising:

a rigid support connecting the first stepped section of the connector with the second section of the connector.

7. The connector of claim 6, further comprising:

a second rigid support connecting the first stepped section of the connector with the second section of the connector and opposite to the rigid support.

8. The connector of claim 1, wherein the first, second, and third sets of signal contacts comprise arched pins.

9. The connector of claim 1, further comprising:

a third section comprising a spring to apply force to the circuit card to maintain contact between the third set of signal contacts on the connector and the third set of signal contacts on the circuit card.

10. The connector of claim 9, wherein the third section comprises a contact to deliver power to the circuit card.

11. The connector of claim 9, wherein the third section comprises a ground contact.

12. The connector of claim 1, further comprising:

a protrusion to be accepted by a hole on the circuit card to align the sets of contacts on the circuit card to the sets of signal contacts on the connector.

13. The connector of claim 12, wherein the protrusion is to further aid in retaining the circuit card on the connector.

14. The connector of claim 12, further comprising a second protrusion to be accepted by a second hole on the circuit card to align the sets of contacts on the circuit card to the sets of signal contacts on the connector, wherein the protrusion and the second protrusion are disposed on rigid supports connecting the first stepped section of the connector with the second section of the connector.

15. The connector of claim 12, wherein the protrusion is disposed on one of the first stepped section and the second section of the connector.

16. The connector of claim 1, further comprising:

a hole to align with a second hole on the circuit card, the hole and the second hole to accept a screw to aid in retaining the circuit card on the connector.

17. The connector of claim 16, wherein one of the first stepped section and the second section of the connector comprises the hole.

18. The connector of claim 1, wherein the connector is to connect the circuit card with a circuit board, and wherein the circuit card and the connector are to be disposed substantially parallel with the circuit board.

* * * * *